US011082760B2

(12) United States Patent
Sterling

(10) Patent No.: US 11,082,760 B2
(45) **Date of Patent: *Aug. 3, 2021**

(54) VIBRATION CANCELLING SPEAKER ARRANGEMENT

(71) Applicant: HARMAN INTERNATIONAL INDUSTRIES, INCORPORATED, Stamford, CT (US)

(72) Inventor: Brian Sterling, Farmington Hills, MI (US)

(73) Assignee: HARMAN INTERNATIONAL INDUSTRIES, INCORPORATED, Stamford, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/843,478

(22) Filed: Apr. 8, 2020

(65) Prior Publication Data

US 2020/0236450 A1 Jul. 23, 2020

Related U.S. Application Data

(63) Continuation of application No. 16/072,030, filed as application No. PCT/US2017/015028 on Jan. 26, 2017, now Pat. No. 10,652,638.

(Continued)

(51) Int. Cl.

*H04R 1/02* (2006.01)
*H04R 5/02* (2006.01)

(Continued)

(52) U.S. Cl.

CPC ..... *H04R 1/025* (2013.01); *H04R 1/02* (2013.01); *H04R 1/2888* (2013.01); *H04R 1/403* (2013.01);

(Continued)

(58) Field of Classification Search

CPC ..... H04R 1/025; H04R 1/227; H04R 1/2811; H04R 1/2826; H04R 1/2849; H04R 1/403; H04R 2201/021; H04R 2201/40

See application file for complete search history.

(56) References Cited

U.S. PATENT DOCUMENTS 2,544,742 A * 3/1951 Volf ..... H04R 1/403 181/145
3,393,764 A * 7/1968 Schafer ..... H04B 1/22 181/147

(Continued)

FOREIGN PATENT DOCUMENTS

WO 2016160020 A1 10/2016
WO 2017132313 A1 8/2017

OTHER PUBLICATIONS

International Search Report and Written Opinion for Application No. PCT/US2017/015028, dated May 23, 2017, 11 pages.

(Continued)

*Primary Examiner* — Ryan Robinson
(74) *Attorney, Agent, or Firm* — Brooks Kushman P.C.

(57) ABSTRACT

A speaker assembly for being mounted within a wall is provided. The speaker assembly has a housing and a plurality of transducers supported by the housing. Each transducer has a front radiation surface and a radiation rear surface adapted to radiate sound along a central axis. The transducers are arranged relative to each other so the central axes of acoustic radiation of each of the transducers intersect at a circumcenter defined between the plurality of transducers to substantially cancel vibrations from the plurality of transducers. A slot is formed adjacent of each of the transducers. The slot extending a depth dimension of the assembly between a slot opening for transmitting acoustic radiation from the plurality of transducers and a back wall of the (Continued)

housing, wherein the depth dimension is generally perpendicular to the central axes of acoustic radiation of each of the transducers.

21 Claims, 3 Drawing Sheets

Related U.S. Application Data

(60) Provisional application No. 62/287,297, filed on Jan. 26, 2016.

(51) Int. Cl.

| | |
|---|---|
| ***H04R 1/28*** | (2006.01) |
| ***H04R 31/00*** | (2006.01) |
| ***H04R 1/40*** | (2006.01) |
| ***H04R 3/12*** | (2006.01) |
| *H04R 1/26* | (2006.01) |

(52) U.S. Cl.
CPC ..... *H04R 3/12* (2013.01); *H04R 5/02* (2013.01); *H04R 31/006* (2013.01); *H04R 1/26* (2013.01); *H04R 2201/021* (2013.01)

(56) References Cited

U.S. PATENT DOCUMENTS 3,688,864 A * 9/1972 Guss ..... H04R 1/26 381/89
4,268,719 A * 5/1981 Manger ..... H04R 1/02 381/89
4,733,749 A 3/1988 Newman et al.
5,097,514 A * 3/1992 McNeill ..... H04R 1/26 181/199
5,253,301 A * 10/1993 Sakamoto ..... H04R 1/2826 181/145
5,388,162 A 2/1995 Sohn
5,561,717 A * 10/1996 Lamm ..... H04R 1/02 381/89
5,619,581 A 4/1997 Ferguson et al.
6,628,792 B1 9/2003 Paddock
6,739,424 B2 * 5/2004 Ogura ..... H04R 1/403 181/145
6,985,593 B2 1/2006 Nichols et al.
7,011,178 B2 * 3/2006 Morkerken ..... H04R 1/2826 181/144
7,133,533 B2 11/2006 Chick et al.
7,433,483 B2 10/2008 Fincham
7,499,555 B1 * 3/2009 Isvan ..... H04R 1/1075 381/182
7,551,749 B2 6/2009 Rosen et al.
7,840,018 B2 * 11/2010 Prenta ..... H04R 1/026 381/152
7,983,436 B2 7/2011 Nichols et al.
8,027,500 B2 9/2011 Fincham
8,031,896 B2 10/2011 Chick et al.
8,180,076 B2 5/2012 Bastyr et al.
8,189,841 B2 5/2012 Litovsky et al.
8,259,983 B2 * 9/2012 Nedelcu ..... H04R 1/025 381/354
8,396,240 B2 3/2013 Rosen
8,457,340 B2 6/2013 Fincham
8,477,966 B2 7/2013 Prenta et al.
8,571,240 B2 10/2013 Bastyr et al.
8,594,358 B2 11/2013 Litovsky et al.
8,798,308 B2 8/2014 Litovsky et al.
9,191,747 B2 11/2015 Dodd
9,363,586 B2 * 6/2016 Fincham ..... H04R 1/403 181/145
9,609,405 B2 * 3/2017 Fincham ..... H04R 1/2896
2004/0173402 A1 9/2004 Morkerken
2005/0018868 A1 1/2005 Chick et al.
2006/0177075 A1 8/2006 Opie et al.
2010/0272295 A1 * 10/2010 Nakatani ..... H04R 1/26 381/160
2010/0294588 A1 11/2010 Imai et al.
2014/0064539 A1 3/2014 Link et al.
2014/0105426 A1 4/2014 Fincham
2014/0114249 A1 4/2014 Meyers et al.

OTHER PUBLICATIONS

Extended European Search Report of European Application No. 17744866.9 dated Aug. 19, 2019, 4 pages.

* cited by examiner

VIBRATION CANCELLING SPEAKER ARRANGEMENT

CROSS-REFERENCE TO RELATED APPLICATIONS

This application is a continuation of U.S. application Ser. No. 16/072,030, filed Jul. 23, 2018, which is the U.S. national phase of PCT Application No. PCT/US2017/015028 filed Jan. 26, 2017, which claims the benefit of U.S. provisional application Ser. No. 62/287,297, filed Jan. 26, 2016, the disclosures of which are hereby incorporated in their entirety by reference herein.

TECHNICAL FIELD

The present disclosure generally relates to speakers, and more particularly, to speakers for mounting with a wall mounting.

BACKGROUND

Loudspeakers are universally known and utilized in audio systems for the reproduction of sound. In some applications, the speakers are required to be mounted or packaged within a wall, such as a trim panel. U.S. Pat. Nos. 7,840,018 and 8,477,966 by Harman International Industries are examples of in-wall speaker systems.

SUMMARY

In at least one embodiment, a speaker assembly for being mounted within a wall is provided. The speaker assembly has a housing and a plurality of transducers supported by the housing. Each transducer has a front radiation surface and a radiation rear surface adapted to radiate sound along a central axis. The transducers are arranged relative to each other so the central axes of acoustic radiation of each of the transducers intersect at a circumcenter defined between the plurality of transducers to substantially cancel vibrations from the plurality of transducers.

In another embodiment, the speaker assembly has a slot formed adjacent of each of the transducers. The slot extends a depth dimension of the assembly between a slot opening for transmitting acoustic radiation from the plurality of transducers and a back wall of the housing, wherein the depth dimension is generally perpendicular to the central axes of acoustic radiation of each of the transducers.

In a further embodiment, wherein a transducer depth is defined between the front radiation surface and the rear radiation surface, wherein the depth dimension of the speaker assembly is less than the transducer depth.

In yet another embodiment, the speaker assembly has a plurality of slots, one of the plurality of slots formed along the front radiation surface of each of the plurality of transducers, wherein the rear radiation surfaces of each of the plurality of transducers are positioned adjacent each other.

In a further embodiment, at least one of the plurality of transducers is positioned so that the rear radiation surface is disposed in the slot.

In yet another embodiment, the slot is defined along the front radiation of each of the plurality of transducers.

In another embodiment, the slot opening is shaped as an equiangular polygon having generally equal angles between each polygon-side, wherein one of the plurality of transducers is disposed along each polygon-side.

In still another embodiment, the transducers are arranged in a radial array so the central axes of radiation are equiangular from each other.

In a further embodiment, the plurality of transducers comprises an odd number of transducers.

In yet another embodiment, the slot opening is shaped as a triangle.

In another embodiment, the housing encloses at least one radiation surface of each of the transducers.

In a further embodiment, a rear surface of at least one of the transducers is not sealed within the housing thereby defining an infinite baffle.

In at least one embodiment, a speaker assembly is provided having a frame and a plurality of transducers supported by the frame. Each transducer has a central axis of radiation defined from at least one radiation surface. The frame defines a slot having a slot opening for transmitting the acoustic radiation from the plurality of transducers. The central axes of acoustic radiation of each of the transducers intersect at a center axis of the slot. The slot opening is defined in a plane generally parallel to the central axes of acoustic radiation of each of the transducers.

In another embodiment, the plane of the slot opening is generally perpendicular to the center longitudinal axis of the slot where the central axes of acoustic radiation of each of the transducers intersect.

In a further embodiment, the plurality of transducers comprises at least a first and second transducer, wherein the central axes of radiation of the first and second transducer are collinear.

In yet another embodiment, the plurality of transducers comprises a first pair of transducers and a second pair of transducers. The central axes of radiation of the first pair of transducers are collinear. The central axes of radiation of the second pair of transducers are collinear and parallel to the central axes of radiation of the first pair of transducers.

In another embodiment, the slot is defined along a front face of each of the plurality of transducers.

In a further embodiment, each transducer has a front radiation surface and a rear radiation surface, where the slot is positioned along at least one of the front and the rear radiation surface of each transducer.

In at least one embodiment, a speaker system is provided. A speaker frame is provided for mounting to a wall about an opening. The frame defines a slot having a slot depth extending from a speaker opening to a back wall. A plurality of transducers is mounted to the frame. Each transducer has a central axis of radiation defined from at least one of a front radiation surface and a rear radiation surface. The transducers are oriented so a central axis of acoustic radiation of each of the transducers intersects at a circumcenter defined between the plurality of transducers to substantially cancel vibrations from the plurality of transducers. The slot depth is less than a speaker depth between the front radiation surface and rear radiation surface.

In a further embodiment, the speaker opening is defined in a plane generally parallel to the central axis of radiation of each of the transducers.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
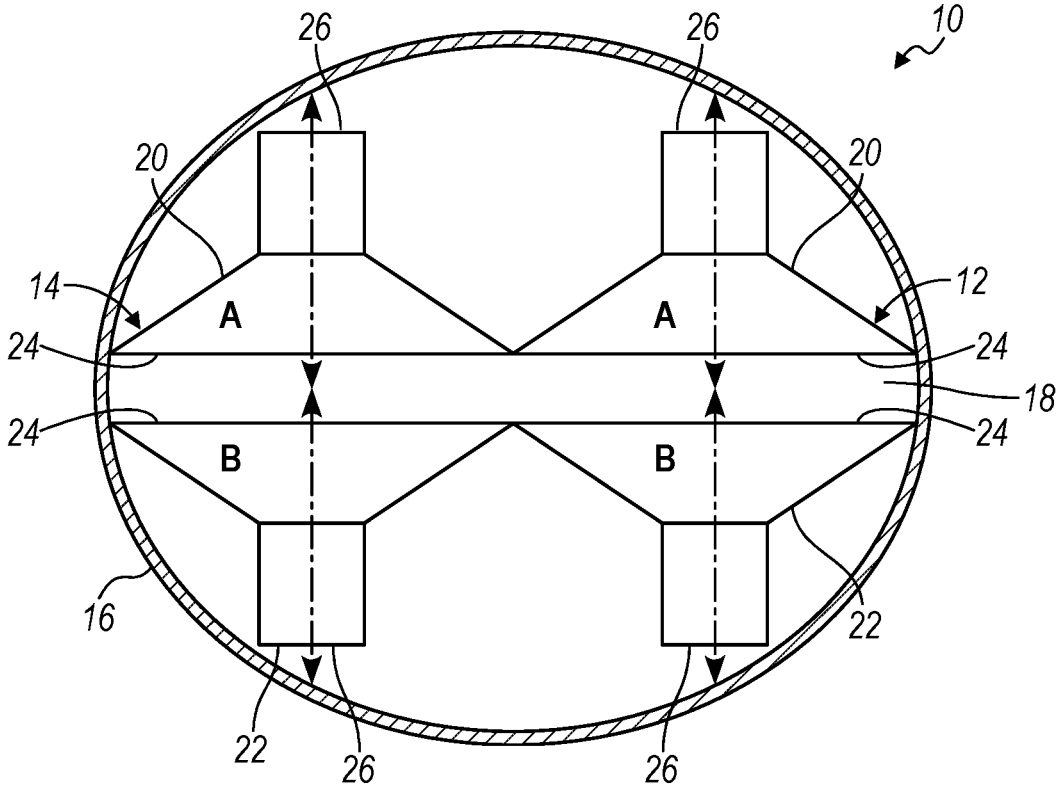
FIG. 1 illustrates a schematic view of a vibration cancelling speaker system according to one embodiment of the present disclosure.

FIG. 1 is a schematic view of one example of a speaker system 10. The speaker system may be mounted in a wall and used in applications in homes, vehicles or other applications where in-wall speakers are utilized. In at least one embodiment, the speaker system is a woofer, or subwoofer. The term woofer may mean either a subwoofer or a traditional woofer. Subwoofers and traditional woofers operate in the bass range. In general, the bass range is a low frequency range, which may be around 20 Hertz (Hz) to 400 Hz. In the bass range, subwoofers generally emit sound between 20 Hz and 200 Hz, and traditional woofers generally emit sound between 40 Hz and 400 Hz. As used herein, the woofer could be a subwoofer or a traditional woofer.

The speaker system 10 includes a first pair of transducers 12, a second pair of transducers 14. The system 10 includes a speaker housing 16, or enclosure containing the first and second pair of transducers 12, 14 and may be installed inside a wall section. As shown, the enclosure 16 is elliptical shaped. The elliptical shape may minimize the housing space required to mount the speaker system or may be mounted in an existing traditional speaker opening. However, other speaker housing shapes may be utilized.

In woofer enclosure design, as the enclosure volume decreases, the moving mass increases. When the enclosure volume becomes very small, the moving mass becomes very large. The acceleration of this moving mass during transducer operation generates an action force proportional to the mass and acceleration. The sound pressure level (SPL) is proportional to the acceleration, so small enclosures producing a high SPL generate significant action forces. These forces are reflected onto the enclosure mounting points of the transducers as reaction forces. The force on these mounting points can cause mechanical vibrations on the surfaces they are attached to. Sound pressure level (SPL) airflow can also cause mechanical vibrations of the surfaces in the vicinity of the transducer mounting. These mechanical vibrations can cause the surfaces to produce audible noises, which are undesirable.

Multiple transducers may be arranged so that their reaction forces cancel, thereby eliminating mounting point mechanical vibration induced noises. By mounting the transducers in enclosures, acoustic radiation from the rear of the transducer is contained, eliminating mounting surface acoustical vibration induced noises.

The pairs of transducers 12, 14 are mounted inside the speaker housing 16 such that they face each other and are separated by a slot 18. The pairs of transducers 12, 14 each have an upper transducer 20 and a lower transducer 22 that have a diaphragm surface along a front 24 that generates sound by its vibration. The upper transducers 20 have acoustic radiation in direction A, while the lower transducers 22 have acoustic radiation in direction B. The vibration direction A is equal and opposite the vibration direction B. By slot-loading the transducers, acoustic radiation A, B from the front 24 of each of the transducers can be better controlled, eliminating grill surface acoustical vibration induced noises. Further, the acoustic radiation A, B from the rear 26 of the transducers is also equal and opposite so that the reaction forces in each pair of transducers 12, 14 cancel each other and minimize undesirable vibration. The central axes of acoustic radiation A, B are co-linear. The central axis of acoustic radiation is generally perpendicular to the transducer. As such, the pairs of transducers 12, 14 are generally parallel.

Further by slot-loading the transducers, new form factors or aspect ratios can be realized, allowing transducer placement in areas that were previously unfeasible. In one example, shown in FIGS. 1-4, the housing has a width W of approximately 239 mm, a height H of approximately 207 mm and a depth D of approximately 76 mm. In this example, the woofer speaker system 10 may be housed in a wall only 76 mm thick, such as in a vehicle door where the speaker system 10 is concealed by the door trim. Only an opening for the slot 18 would be visible on the vehicle door trim. In this example, the speaker system 10 may be packaged in a space previously occupied by a traditional speaker.

One end of the slot 18 is open, defining the front speaker opening 28 of the slot 18. The back wall 32, opposite the speaker opening 28, is closed so that sound pressure radiates from the speaker opening 28.

Figure 5:
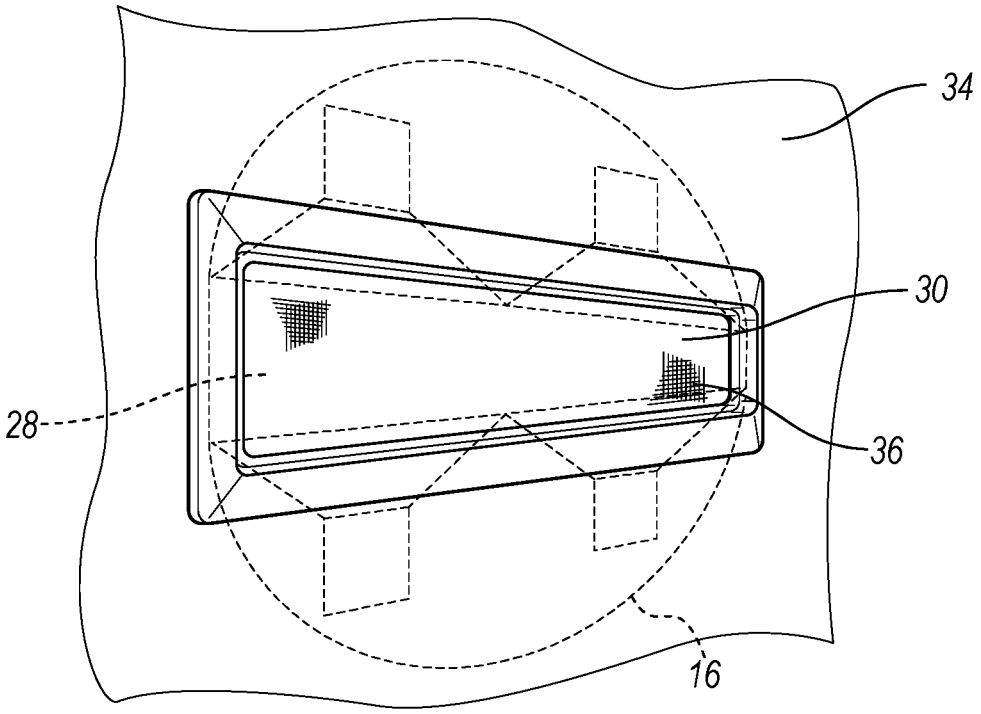
FIG. 5 illustrates a front view of the speaker system of FIG. 2 when mounted in a wall.
Figure 2:
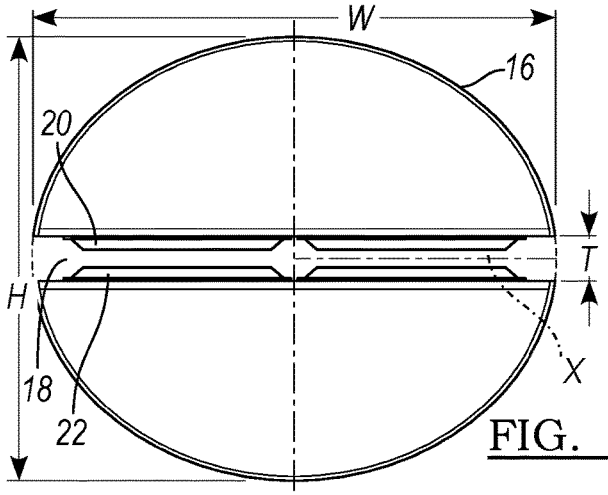
FIG. 2 illustrates a front perspective view of the speaker system of FIG. 1.
Figure 3:
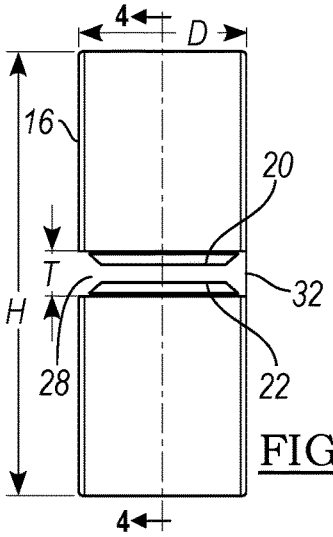
FIG. 3 illustrates a side perspective view of the speaker system of FIG. 2.
Figure 4:
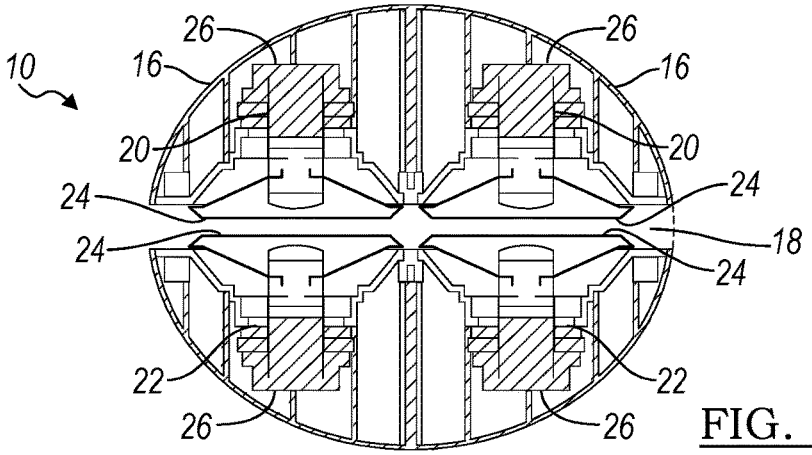
FIG. 4 illustrates a section view of the speaker system shown along section 4-4 of FIG. 3.

Slot-loading also minimizes effective radiating area, allowing smaller grill openings, enabling even more transducer placement options and industrial design flexibility. For example, FIG. 5 illustrates the grill opening 30 in a wall of the speaker system 10 shown in FIGS. 1-4. The grill opening 30 is approximately the size of the front speaker opening 28 of the slot 18. In the example shown in FIGS. 1-4, the speaker opening 28 and grill opening 30 may have a width W being approximately 239 mm wide and a thickness T of approximately 25 mm high. The speaker opening 28 and grill opening 30 are defined in a plane generally parallel to the central axis of acoustic radiation of each of the transducers. As shown in FIG. 1-4, the front 24 of the transducers 20, 22 may extending partially into the slot 18. Further, the plane defined by the speaker opening 28 is generally perpendicular to the center longitudinal axis X of the slot, along which the central axes of acoustic radiation A,B intersect. As shown in FIG. 1-4, the front 24 of the transducers 20, 22 may extending partially into the slot 18.

The wall 34 may include a building wall or a vehicle wall such as a door, rear deck or tailgate, or any other application where the speaker is required to be mounted within a structure.

When installed in a wall 34, the speaker opening 28 of the slot 18 may define the grill opening 30 of the housing 16, as shown in FIG. 5. The grill opening 30 may be open or covered with a vented covering 36, such as a fabric or mesh that may additionally provide a decorative exposure to the wall containing the speaker assembly 10.

Figure 6:
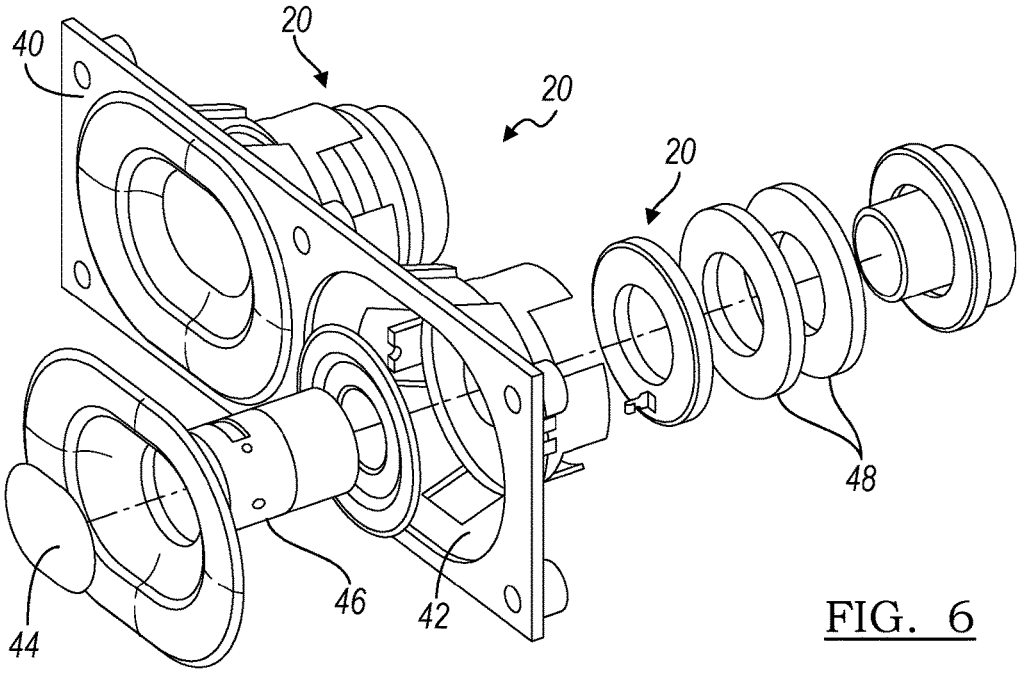
FIG. 6 illustrates an exploded view of a transducer.

FIG. 6 illustrates an example of transducers, such as two upper transducers 20. The transducers 20 are mounted to a frame 40 that is secured to the housing 16. The frame 40 has openings 42 provided for mounting the transducer components such as the diaphragm assembly 44. The transducer illustrated in FIG. 6 is an active radiator having a voice coil 46 and magnet assembly 48. However, it is also expected that the speaker systems may similarly include passive radiators or tuned ports.

Slot-loading also allows even more transducer placement options and industrial design flexibility. FIGS. 7-10 illustrate slot-loaded speaker arrangements with an odd number of transducers.

Figure 7:
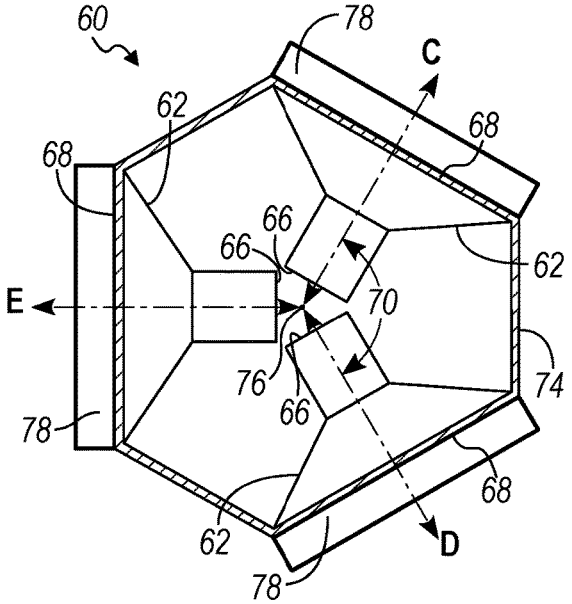
FIG. 7 illustrates a schematic view of a vibration cancelling speaker system according to another embodiment.

FIG. 7 illustrates a speaker assembly 60 having three transducers 62. The rear surfaces 66 of each of the transducers are oriented adjacent to each other. The front surfaces 68 of each of the transducers are positioned away from each other. Each of the three transducers 62 are arranged at an equal angle 70 from each other in a radial array. As shown in FIG. 7, the three transducers are oriented so that the central axes C, D, E of the acoustic radiation are angularly equidistant from each other. In this example with three transducers, the central axes C, D, E are oriented at generally 120 degrees from each other. The acoustic radiation C, D, E from the rear surfaces 66 intersects at the circumcenter 76 of the housing 74.

As illustrated in FIG. 7, the transducers 62 are disposed within the housing 74. The housing 74 is a shaped as a hexagon with one of the transducers mounted on alternating sides of the hexagon. However, the housing could also be triangular, with one of the transducers 62 mounted on each side of the housing. The housing 74 forms one side of a rectangular slot 78 along the front surface 68 of each of the transducers 62. The speaker assembly 60 would have three grill openings in a wall that correspond to the three rectangular slots 78.

The diaphragm surfaces of each transducer 62 are positioned generally perpendicular to the surface of the wall in which the speaker assembly 60 is mounted. The slots 78 permit sound pressure radiation from the transducers 62. Alternately, the slots could be removed and the transducers radiate directly. With this configuration, the speaker assembly could be used in a room or vehicle to replace a conventional speaker assembly, while retaining the mechanical and acoustical vibration induced noise reduction benefits.

Figure 8:
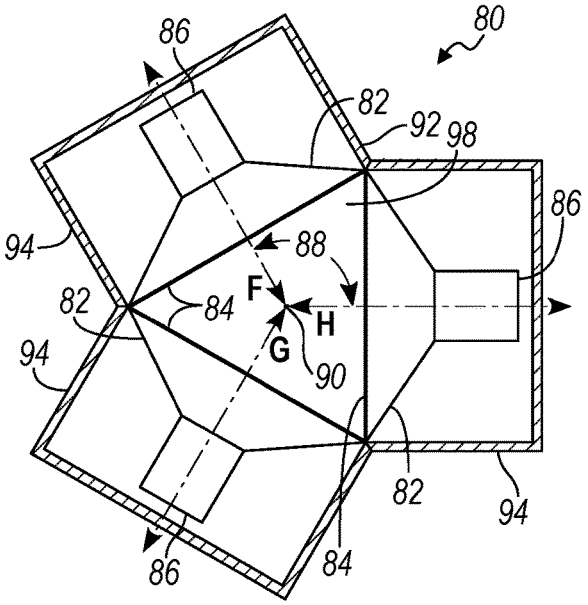
FIG. 8 illustrates a schematic view of a vibration cancelling speaker system according to another embodiment.

FIG. 8 illustrates another speaker assembly 80 having three transducers 82. The front surfaces 84 of each of the transducers are oriented adjacent and toward each other. The rear surfaces 86 of each of the transducers are positioned away from each other. Each of the three transducers 82 are arranged at an equidistant angle 88 from each other in a radial array. As shown in FIG. 8, the three transducers are oriented so that the central axes F, G, H of the acoustic radiation are angularly equidistant from each other. In this example with three transducers, the central axes F, G, H are oriented at generally 120 degrees from each other. The acoustic radiation F, G, H from the front surfaces 84 intersect at the circumcenter 90 of a slot 98. The transducers 82 may be mounted in a frame that defines the slot 98.

As illustrated in FIG. 8, the transducers 82 are enclosed in a housing 92. The housing 92 may have three sections 94 so that each section 94 houses one of the transducers 82. The sections 94 are connected together to form a triangular slot 98. The speaker assembly 80 would have a triangular grill opening in a wall that corresponds to the triangular slot 98. The diaphragm surfaces of each transducer 82 are positioned perpendicular to the surface of the wall in which the speaker assembly 80 is mounted. The triangular slot 98 permits sound pressure radiation from the transducers 82.

Figure 9:
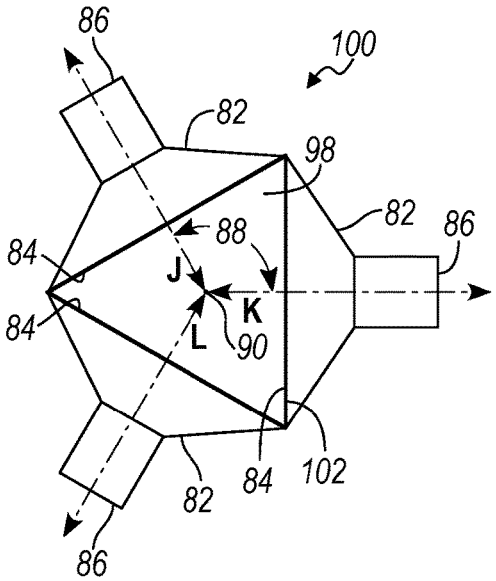
FIG. 9 illustrates a schematic view of a vibration cancelling speaker system according to another embodiment.

Similar to FIG. 8, FIG. 9 illustrates another speaker assembly 100 having three transducers 82. In the embodiment in FIG. 9, the transducers 82 are mounted to a frame 102 defining the triangular slot 98, but there is no housing covering the rear surfaces 86 of the transducers. The rear surface 86 of the transducers is open to the surrounding environment. When the transducer is not within an housing, like in FIG. 9, the transducer is considered to operate in an infinite baffle. The acoustic radiation J, K, L from the front surfaces 84 intersect at the circumcenter 90 of the frame 102 and slot 98. The acoustic radiation J, K, L from the rear surfaces 86 is not contained in an enclosure.

Some of the benefits of the infinite baffle include: reduction of undesirable increase in resonance frequency of the woofer, reduction of strain on the diaphragm, etc. As a result, the woofer operating in an infinite baffle produces a higher sound pressure level (SPL) at low frequency ranges. Further, without an enclosure, the assembly 100 may be packaged in a smaller space.

Figure 10:
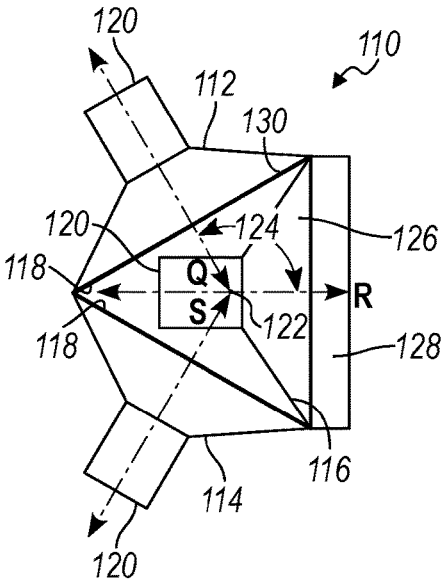
FIG. 10 illustrates a schematic view of a vibration cancelling speaker system according to another embodiment.

FIG. 10 illustrates another speaker assembly 110 having three transducers 112, 114, 116. The front surfaces 118 of transducer 112 and transducer 114 are oriented adjacent and toward each other. Transducer 116 is oriented opposite so that the rear surface 120 is oriented adjacent and toward the front surfaces of transducers 112 and 114.

As shown in FIG. 10, the three transducers are oriented so that the central axes Q, R, S of the acoustic radiation are angularly equidistant from each other. Each of the three transducers 112, 114, 116 is arranged at an equidistant angle 124 from each other in a radial array based on the central axes Q, R, S. In this example with three transducers, the central axes Q, R, S are oriented at generally 120 degrees from each other. The acoustic radiation Q, R from the front surface 118 of transducers 112 and 114 and the acoustic radiation S from the rear surface 120 of transducer 116 intersect at the circumcenter 122. In the speaker arrangement in FIG. 10, transducer 116 has reverse polarity in order to effectively cancel the forces and minimize vibration.

In the embodiment illustrated in FIG. 10, the transducers 112, 114, 116 are mounted to a frame 130 that defines the slot 126. The frame 130 forms a slot 126 having a generally triangular shape. The speaker assembly 110 would have a grill opening in a wall that corresponds to the slot 126. The diaphragm surfaces of each transducer 112, 114, 116 are positioned perpendicular to the surface of the wall in which the speaker assembly 110 is mounted. The slot 126 permits sound pressure radiation from the transducers 112, 114, 116. The speaker assembly 110 may include a space 128 to allow for movement of the diaphragm of transducer 116.

The transducers 112 and 114 do not have an enclosure containing the rear surfaces 120. The rear surfaces 120 are open to the surrounding environment and are considered to operate in an infinite baffle. The transducer 116 does not have an enclosure containing the front surface 118. The front surface 118 of transducer 116 is open to the surrounding environment and is also considered to operate in an infinite baffle. The rear surface 120 of transducer 116 is disposed within the slot 126. The arrangement of the transducers in FIG. 10 may allow a compact speaker assembly 110 that can be packaged in small spaces while maintaining optimal bass range performance.

Other numbers of transducers could also be oriented similarly to FIGS. 7-10. In particular, odd numbers of transducers could also be oriented similarly to FIGS. 7-10. For example, if there were five transducers, the central axes of acoustic radiation would be oriented at 72 degrees from each other. Similarly, in a woofer assembly having nine transducers, the central axes of acoustic radiation would be oriented at 40 degrees from each other. An even number of transducers could also be oriented similarly to FIGS. 7-10. For example, four transducers may be arranged in a radial array oriented at 90 degrees from each other so that the central axes of acoustic radiation all intersect and thereby having a square or rectangular shaped slot.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A speaker assembly comprising:

a housing;

a plurality of transducers supported by the housing, each transducer having a front radiation surface and a radiation rear surface adapted to radiate sound along a central axis, wherein a transducer depth is defined between the front radiation surface and rear radiation surface, at least one slot formed in the housing and having a slot opening in the housing for transmitting acoustic radiation from the plurality of transducers, the slot extending a depth dimension of the assembly between the slot opening and a back wall of the housing, wherein the transducer depth is defined between the front radiation surface and the rear radiation surface, wherein the depth dimension of the speaker assembly is less than the transducer depth, wherein the depth dimension is generally perpendicular to the central axes of acoustic radiation of each of the transducers.

2. The speaker assembly of claim 1, wherein at least one of the front radiation surface or the rear radiation surface of each the transducers is open to the slot.

3. The speaker assembly of claim 1, wherein the at least one slot comprises a plurality of slots, one of the plurality of slots formed along the front radiation surface of each of the plurality of transducers.

4. The speaker assembly of claim 1, wherein at least one of the plurality of transducers is positioned so that the rear radiation surface is open to the slot.

5. The speaker assembly of claim 1, wherein the slot is defined along the front radiation surface of each of the plurality of transducers.

6. The speaker assembly of claim 1, wherein the slot opening is shaped as an equiangular polygon having generally equal angles between each polygon-side, wherein one of the plurality of transducers is disposed along each polygon-side.

7. The speaker assembly of claim 1, wherein the transducers are arranged in a radial array so the central axes of acoustic radiation are equiangular from each other.

8. The speaker assembly of claim 1, wherein the housing encloses at least one of the front or rear radiation surface of each of the transducers, and the other of the front or rear radiation surfaces of each of the transducers is open to the slot.

9. The speaker assembly of claim 1, wherein the rear surface of at least one of the transducers is not sealed within the housing thereby defining an infinite baffle.

10. The speaker assembly of claim 1, wherein the central axes of acoustic radiation of each of the transducers intersect at a longitudinal center axis of the slot.

11. The speaker assembly of claim 10, wherein a plane of the slot opening is generally perpendicular to the longitudinal center axis of the slot.

12. The speaker assembly of claim 1, wherein the plurality of transducers comprises at least a first and second transducer, wherein the central axes of radiation of the first and second transducer are collinear.

13. The speaker assembly of claim 1, wherein the plurality of transducers comprises a first pair of transducers and a second pair of transducers, wherein the central axes of radiation of the first pair of transducers are collinear; and wherein the central axes of radiation of the second pair of transducers are collinear and parallel to the central axes of radiation of the first pair of transducers.

14. The speaker assembly of claim 1, wherein the slot is defined along a front face of each of the plurality of transducers.

15. The speaker assembly of claim 1, wherein each transducer has a front radiation surface and a rear radiation surface, where the slot is positioned along at least one of the front and the rear radiation surface of each transducer.

16. A speaker system comprising:

a speaker frame for mounting to a wall about an opening;

a slot defined in the frame and having a slot depth extending from a speaker opening to a back wall of the frame; and a plurality of transducers mounted to the frame, each transducer having at least one of a front radiation surface and a rear radiation surface open to the slot, wherein the slot depth is less than a speaker depth between the front radiation surface and rear radiation surface, wherein each transducer has a central axis of radiation defined from between the front radiation surface and the rear radiation surface, wherein the central axis of radiation of each of the transducers is oriented to intersect in the slot to substantially cancel vibrations from the plurality of transducers.

17. The speaker system of claim 16, wherein the plurality of transducers comprises at least a first and second transducer, wherein the central axes of radiation of the first and second transducer are collinear.

18. The speaker system of claim 16, wherein the transducers are oriented so the central axis of acoustic radiation of each of the transducers intersects at a circumcenter defined between the plurality of transducers to substantially cancel vibrations from the plurality of transducers.

19. A speaker assembly comprising:

a housing;

a plurality of transducers supported by the housing, each transducer having a front radiation surface and a radiation rear surface adapted to radiate sound along a central axis, wherein a transducer depth is defined between the front radiation surface and rear radiation surface, at least one slot formed in the housing and having a slot opening in the housing for transmitting acoustic radiation from the plurality of transducers, the slot extending a depth dimension of the assembly between the slot opening and a back wall of the housing, wherein the transducer depth is defined between the front radiation surface and the rear radiation surface, wherein the depth dimension of the speaker assembly is less than the transducer depth, wherein the plurality of transducers comprises at least a first and second transducer, wherein the central axes of radiation of the first and second transducer are collinear.

20. The speaker assembly of claim 19, wherein the central axes of acoustic radiation of each of the transducers intersect at a longitudinal center axis of the slot.

21. The speaker assembly of claim 20, wherein a plane of the slot opening is generally perpendicular to the longitudinal center axis of the slot.

* * * * *